US005918496A

United States Patent [19]

Hopf

[11] Patent Number: 5,918,496

[45] Date of Patent: Jul. 6, 1999

[54] ADJUSTABLE CLAMP DIE FOR TUBE BENDING MACHINE

[75] Inventor: Werner G. Hopf, San Marcos, Calif.

[73] Assignee: Eagle Precision Technologies, Inc., Canada

[21] Appl. No.: 08/969,719

[22] Filed: Nov. 13, 1997

[51] Int. Cl.[6] ..... B21D 7/04

[52] U.S. Cl. ..... 72/159

[58] Field of Search ..... 72/149, 159, 158, 72/156, 157, 155, 367.1, 369

[56] References Cited

U.S. PATENT DOCUMENTS

| | | |
|---|---|---|
| 1,167,538 | 11/1916 | True . |
| 1,261,229 | 4/1918 | Hansen . |
| 2,974,706 | 3/1961 | DeWitt . |
| 3,118,488 | 1/1964 | Barnhill . |
| 3,974,676 | 8/1976 | Eaton . |
| 4,038,853 | 8/1977 | Schwarze . |
| 4,063,441 | 12/1977 | Eaton . |
| 4,078,411 | 3/1978 | Eaton . |
| 4,178,788 | 12/1979 | Zollweg et al. . |
| 4,495,788 | 1/1985 | Traub . |
| 4,760,726 | 8/1988 | Traub ..... 72/149 |
| 4,843,859 | 7/1989 | Togoshi . |
| 4,888,971 | 12/1989 | Schwarze . |

FOREIGN PATENT DOCUMENTS

| | | |
|---|---|---|
| 1274621 | 9/1961 | France . |

*Primary Examiner*—Joseph J. Hail, III
*Assistant Examiner*—Rodney Butler
*Attorney, Agent, or Firm*—Brown, Martin, Haller & McClain, LLP

[57] ABSTRACT

A clamp die apparatus for co-operating with the bend die of a tube bending apparatus during tube bending has a support bolster adapted for adjustable mounting on a bend arm of a tube bending machine and a primary clamp die rigidly mounted on the support bolster for clamping a portion of a tube against a bend die of the bend arm. A secondary clamp die is movably mounted on the support bolster for movement between an extended position alongside the primary clamp die and a retracted position spaced rearwardly from the primary clamp die. Each clamp die has a clamping surface for bearing against a portion of a tube to be bent, and the clamping surfaces of the primary and secondary clamp dies are aligned to form a clamping surface of extended length when the secondary clamp die is in the extended position. The primary clamp die alone forms a reduced length clamping surface when the secondary clamp die is in the retracted position.

18 Claims, 3 Drawing Sheets

ADJUSTABLE CLAMP DIE FOR TUBE BENDING MACHINE

BACKGROUND OF THE INVENTION

The present invention relates generally to tube bending machines, and is particularly concerned with an adjustable clamp die for a tube bending machine.

Automatic bending machines such as the machines described in U.S. Pat. Nos. 3,974,676 and 4,063,441 of Homer Eaton, assigned to Eaton-Leonard Corp., are arranged to form a series of pre-programmed bends in a length of pipe. An automatic bending machine typically has a fixed, elongated machine bed on which pipe is supported and advanced to a bend head at one end of the machine bed. The pipe at the bend head is gripped between bend and clamp dies, and these dies are rotated together to form a bend in the pipe. The dies are retracted, and the pipe is again advanced to the next bend position.

One problem with existing bend and clamp die arrangements is that, when the clamp die is relatively short, slipping of the pipe may occur when a portion of a long, straight pipe section is to be bent.

SUMMARY OF THE INVENTION

It is an object of the present invention to provide a new and improved clamp die apparatus for a tube bending machine.

According to one aspect of the present invention, a tube bending apparatus is provided which comprises a rotatably mounted bend die, a clamp die assembly co-operating with the bend die for clamping a portion of a tube between the clamp die and bend die, and a drive assembly for driving the bend die and clamp die assembly between a first position aligned with the axis of the tube and a second position rotated relative to the straight tube axis to bend the tube about the bend die, the clamp die assembly comprising a clamp die base, a first, fixed clamp die rigidly mounted on the base and having a clamp axis aligned with the tube axis in the first position, a second, adjustable clamp die rotatably mounted on the clamp die base for movement between an extended position alongside the first clamp die, and a retracted position rotated away from the first clamp die, and a second clamp die drive assembly for driving the second clamp die back and forth between the extended and retracted positions. The first and second clamp dies each have a clamping surface for bearing against a portion of a tube to be bent, and the clamping surfaces are aligned to form a continuous clamping surface when the second clamp die is in the extended position.

The first clamp die opposes the bending die at all times to clamp a portion of the tube to be bent between the bending die and clamp die. When necessary, the second clamp die is rotated into alignment with the first clamp die to form an elongated clamp die, resisting slipping of the tube during bending. The second clamp die will be used primarily when bending part of a long, straight tube section.

When the secondary clamp die is not needed, for example when two bends are located close together, the secondary clamp die is retracted out of the way and the primary clamp die only is used to grip the tube. When two bends are positioned close together, a short section of clamp die will be sufficient, partly because the placement of the clamp die relative to the previous bend essentially locks the tubing under bend in position. When the spacing between the location of a bend to be formed and the previously formed bend is greater than a predetermined maximum, the risk of slipping is such that the secondary clamp die should be used to bear against the tube and resist any slipping. Thus, in this situation, the secondary clamp die is moved into the advanced position. In either case, a drive or actuator rotates the bend and clamp dies together between a first position aligned with the axis of the advancing tube and a second position rotated from the first position so as to bend the tube about the bend die.

In a preferred embodiment of the invention, the drive assembly comprises a hydraulic cylinder and piston mechanism. Preferably, the secondary clamp die is rotatably mounted on the support for movement between the extended and retracted position, and is linked to the drive assembly by a two part linkage of two link members. The first link member is pivoted at one end to the support and at the opposite end to the second link member, and is pivoted to the drive assembly at a location between its opposite ends. The second link member is pivoted at one end to the first link member and at the opposite end to the secondary clamp die.

The secondary clamp die preferably has an extension arm which is rotatably mounted on the support at its free end, and is connected to the two part linkage at an intermediate position between a clamping face of the die and the end of the extension arm. Preferably, opposing stop faces are provided on the extension arm and support base for engagement when the secondary clamp die is in the extended position, to prevent further motion of the clamp die beyond this position. The secondary clamp die is positioned such that it will not interfere with the tubing being bent when it is in the retracted position. In a preferred embodiment of the invention, the secondary clamp die rotates through an angle of 90° between the extended and retracted positions.

Thus, the clamp die assembly of this invention essentially provides a clamp die of adjustable length, with the length adjustment being achievable quickly and easily simply by rotating the secondary clamp die between extended and retracted positions. In the extended position, the secondary clamp die is located alongside the primary clamp die and provides an extended length die face. In the retracted position, the secondary clamp die is moved away from the primary clamp die to leave only a short clamping surface. When using the primary clamp die alone, bends can be made relatively close to one another. Bends can be made in relatively long, straight sections of tubing by using both the primary and secondary clamp dies to form a longer clamp die, reducing the risk of slipping.

BRIEF DESCRIPTION OF THE DRAWINGS

The present invention will be better understood from the following detailed description of a preferred embodiment of the invention, taken in conjunction with the accompanying drawings, in which like reference numerals refer to like parts, and in which.

DESCRIPTION OF THE PREFERRED EMBODIMENT

Figure 1:
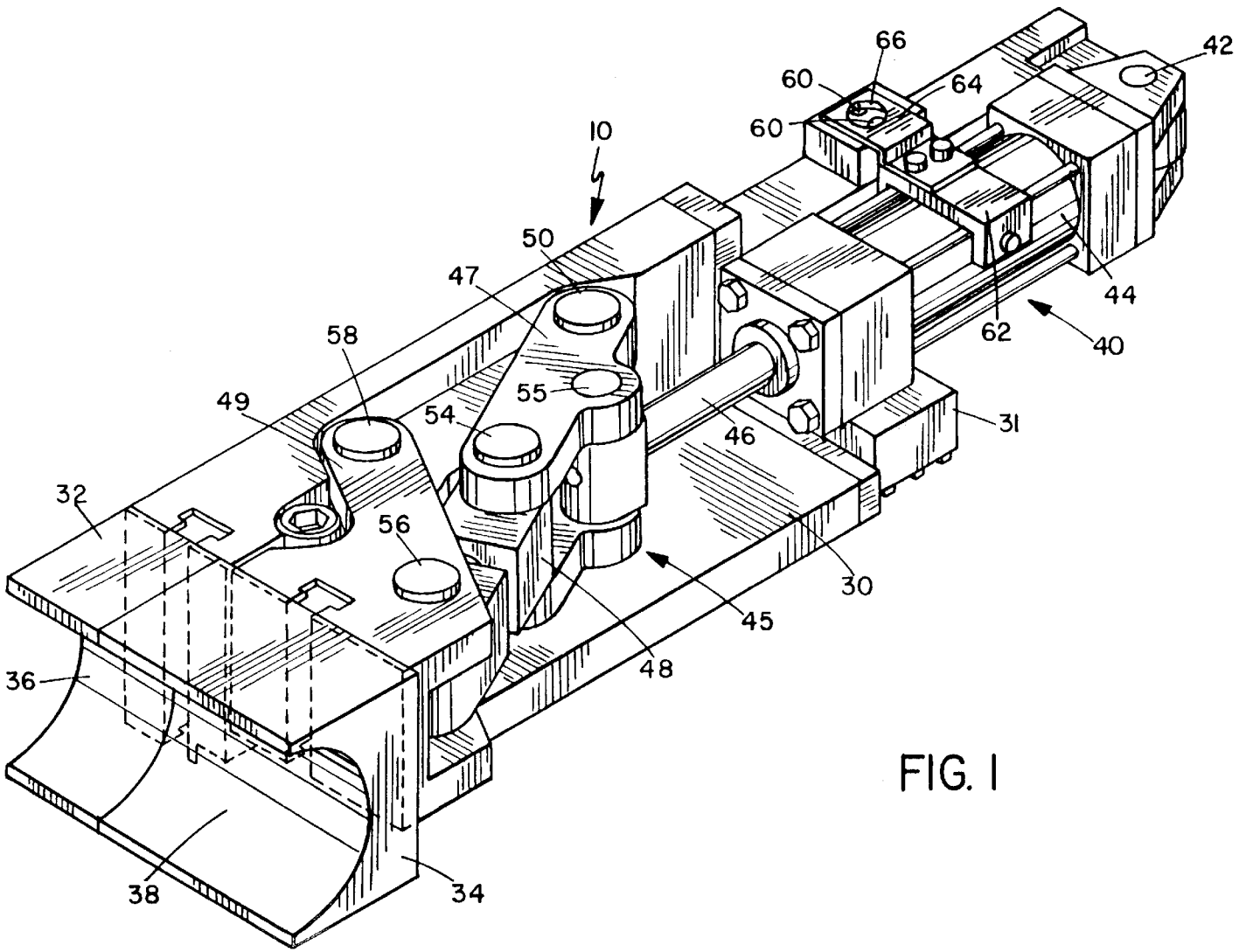
FIG. 1 is a perspective view of a clamp die apparatus according to a preferred embodiment of the present invention.
Figure 2:
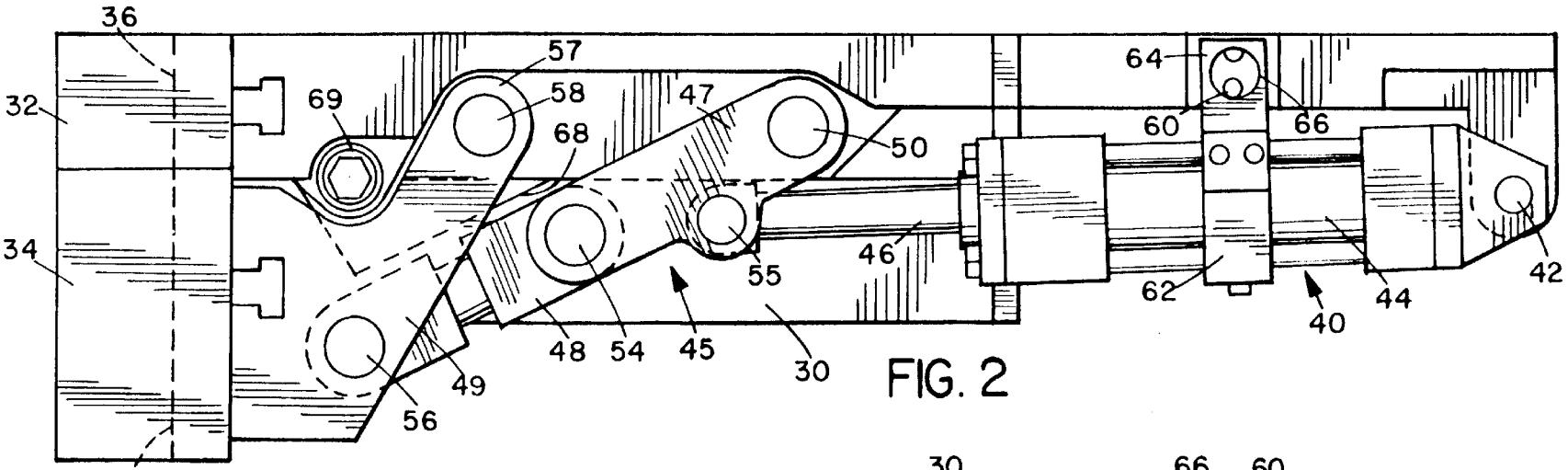
FIG. 2 is a top plan view of the apparatus of FIG. 1, illustrating the secondary clamp die in an extended position.
Figure 3:
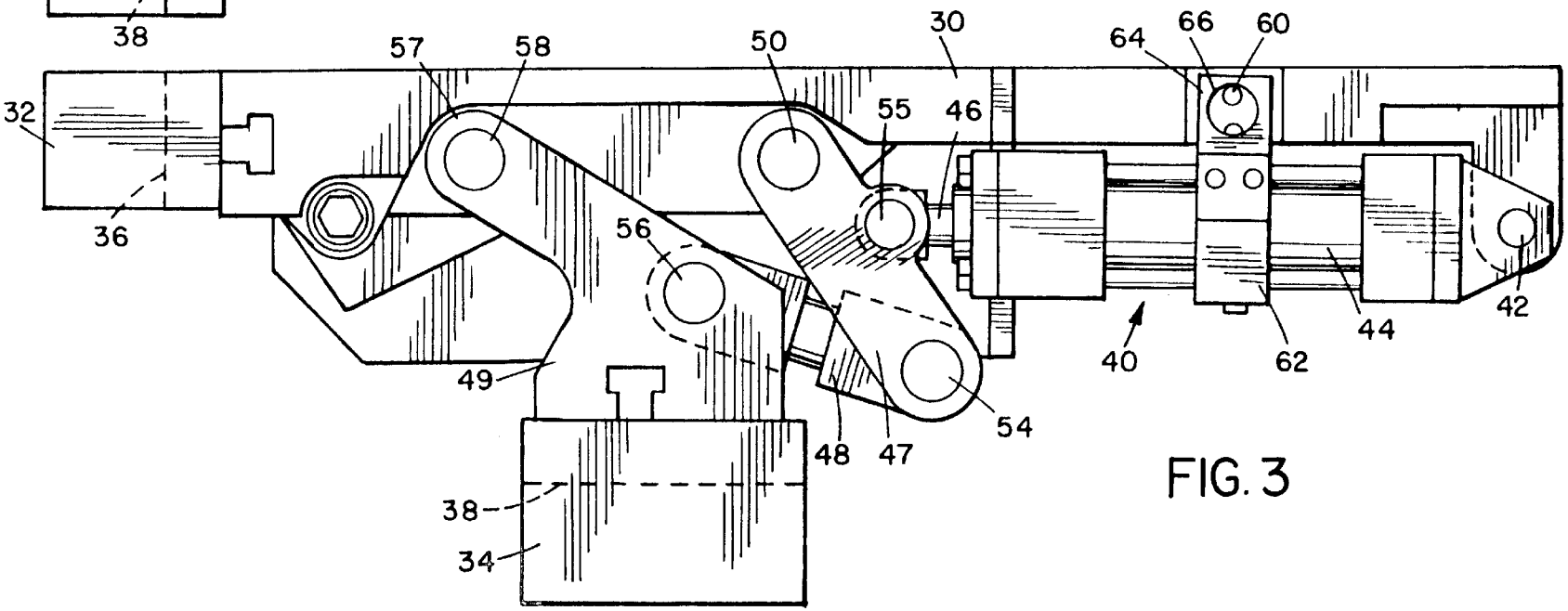
FIG. 3 is a view similar to FIG. 2, illustrating the secondary clamp die in a retracted position.
Figure 4:
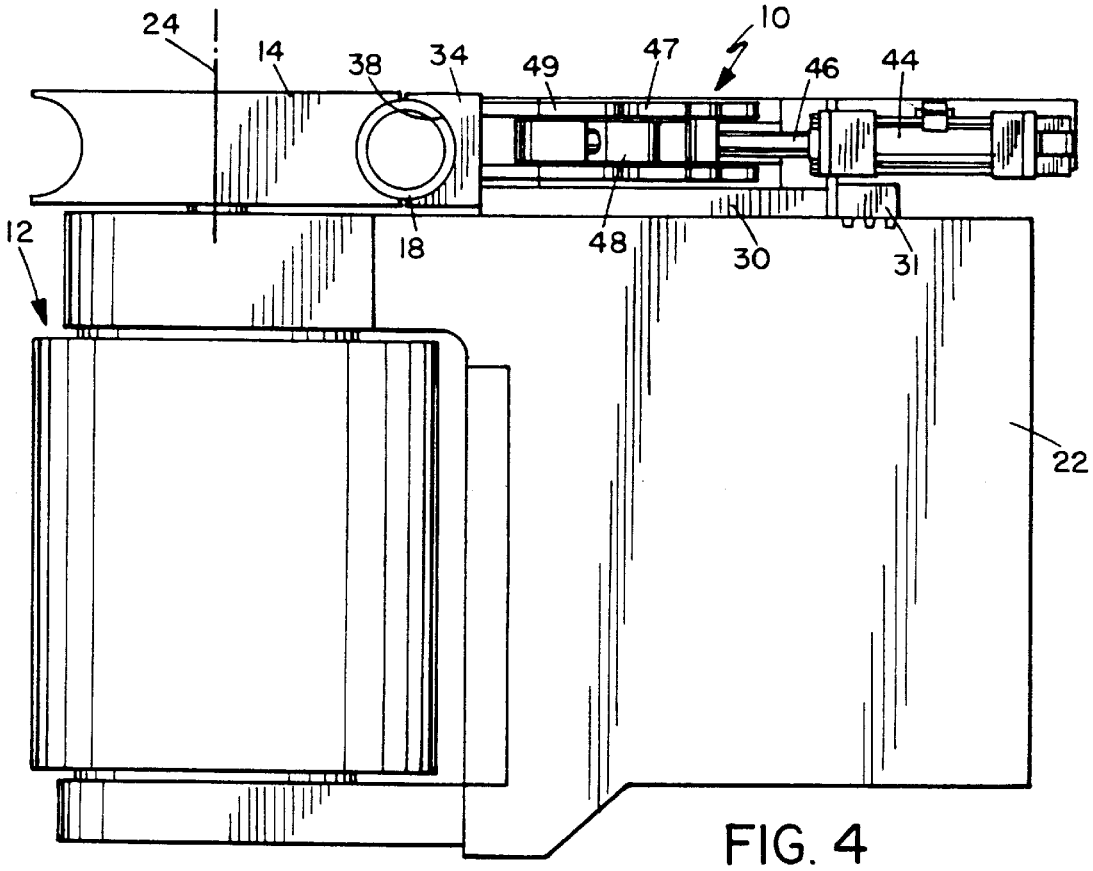
FIG. 4 is an end elevation view of the clamp die apparatus of FIGS. 1 to 3 installed on a bend arm of a tube bending machine with a tube gripped between the clamp die apparatus and bend die.
Figure 5:
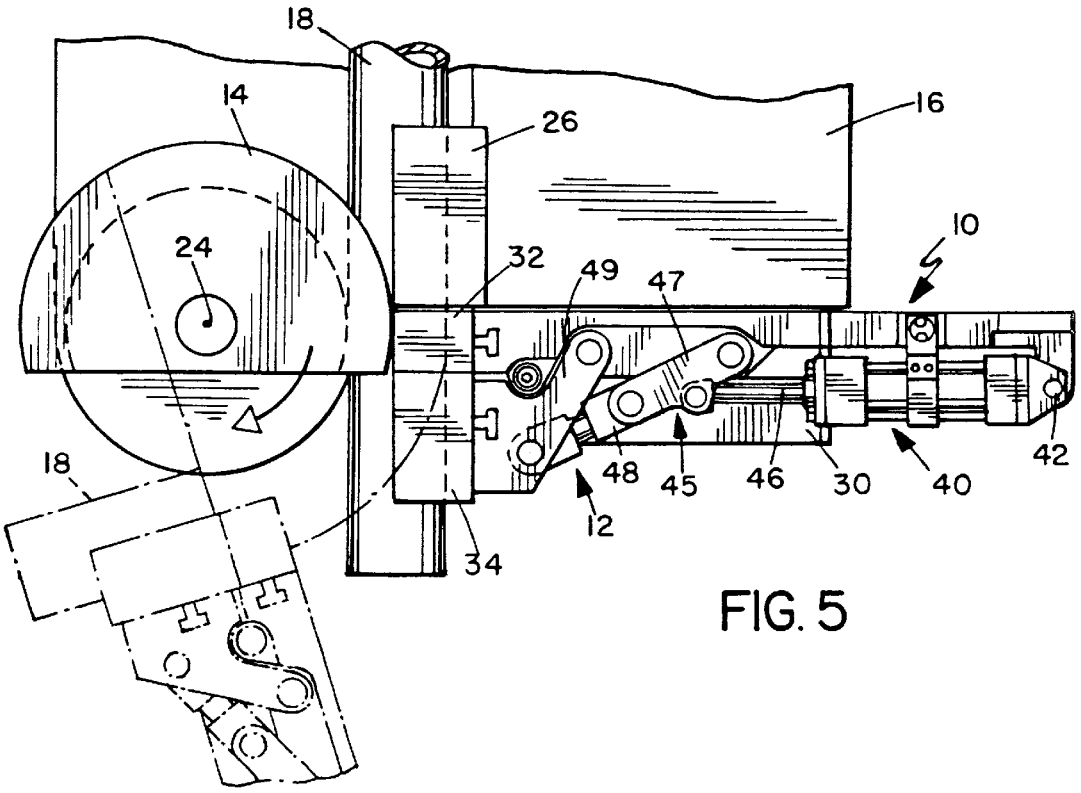
FIG. 5 is a top plan view of the bend arm of FIG. 4 illustrating formation of a bend in the tube.

FIGS. 1 to 3 illustrate a clamp die apparatus according to a preferred embodiment of the present invention for positioning at the forward end of tube bending machine in bend head 12 as illustrated in FIGS. 4 and 5 so as to oppose the bending die 14. The bending machine is otherwise of the type shown and described in U.S. Pat. No. 4,063,441 (hereinafter '441 patent), the contents of which are incorporated herein by reference, and other parts of the machine are therefore not illustrated or described in detail. Although the apparatus 10 is primarily intended for incorporation in a bending machine of the type described in the aforementioned patent, it will be understood that it may alternatively be incorporated in other types of rotary bending machines.

The bending machine basically comprises a fixed, elongated machine bed 16, the forward end of which is visible in FIGS. 5, on which a moving carriage (not visible in the drawings) is mounted. Pipe or tube 18 is gripped by a rotatable chuck (not visible in the drawings) on the carriage, and the carriage advances the tube towards the bend head 12 mounted at the forward end of the machine bed 16. A swinging bend arm assembly 22 is mounted at the forward end of the machine. The bend arm assembly 22 carries the bend die 14 and the clamp die apparatus 10, which opposes the bend die 14. The swinging bend arm assembly 22 is mounted for rotation with the bend die about the axis 24 of the bend die, carrying the clamp die apparatus and its operating mechanism as it rotates, in the manner described in the above referenced '441 patent. The machine also includes a fixed pressure die 26 which opposes the bend die in the initial, solid line position of FIG. 5.

The tube 18 extends between the bend die and the opposing pressure die and clamp die apparatus. The clamp die apparatus 10 will now be described in more detail with reference to FIGS. 1 to 3. The apparatus basically comprises a support base or bolster 30, a primary clamp die 32 rigidly mounted at one end of bolster 30, and a secondary clamp die 34 rotatably mounted on the bolster for rotation between an extended position as illustrated in FIGS. 1 and 2, and a retracted position as illustrated in FIG. 3. The bolster 30 is adjustably carried on the bend arm assembly for movement between an advanced, clamping position as illustrated in FIGS. 4 and 5, and a retracted, inoperative position, in the same manner as the clamp die bolster described in the '441 patent referred to above. A clamp die adjusting block 31 secured to the bolster 30 has a depending toothed face (not visible in the drawings), the teeth of which mesh with a rack fixed to the top of a bend arm slide, as described in the '441 patent. Operation of this mechanism will not be described in detail here since it is identical to that described in the '441 patent.

The primary clamp die 32 has a relatively short, arcuate clamping face 36 for engagement with one side of the tube 18 to grip the tube between clamping face 36 and the opposing face of the bending die 14 as the swing arm rotates about axis 24. The secondary clamp die 34 has an arcuate clamping face 38 which matches that of the primary clamp die and forms an extension of the clamping face of the primary clamp die when in the extended position of FIGS. 1 and 2. In the extended position, the clamping faces of the primary and secondary clamp dies are aligned on the same clamping axis and are side-by-side to form one continuous, elongated clamping face. The secondary clamp die has a longer clamping face than the primary clamp die. Thus, when the secondary clamp die is in the extended position, it will bear against the tube 18 and resist any tendency of the tube to slip as the swing arm rotates to form the bend, as indicated in FIGS. 4 and 5.

Although both of the clamping faces 36 and 38 are straight in the illustrated embodiment in order to form a straight bend in the plane of the clamp die and bending die, the clamp faces may alternatively incorporate bends or arcs in order to accommodate any desired bends out of the plane of the bend and clamp dies, for example as described in U.S. Pat. No. 4,495,788 of Traub, assigned to Eaton-Leonard Corporation, which describes different die shapes to accommodate different bend forms and compound bends. The opposing bend die face will also be shaped to accommodate the desired bend form in such cases.

As noted above, the clamp die apparatus in the illustrated embodiment is designed for forming bends in the plane of the bend and clamp dies, in an otherwise straight length of tube. Preferably, the length of clamping face 38 of the secondary clamp die is longer than that of the clamping face 36 of the primary clamp die 34. The length of the clamping face of the primary clamp die 34 is preferably in the range of 1" to 2", while the length of the clamping face of the secondary clamp die is in the range from 1" to 4". In one specific example of a straight die, the face 36 had a length of around 2" while the face 38 had a length of around 4", making a possible total clamp face length of 6".

A hydraulic drive assembly 40 for moving the secondary clamp die between the extended and retracted positions is pivotally secured at one end to a rear end of the support member or bolster 30 via pivot pin 42. The assembly 40 comprises hydraulic cylinder 44 and piston or ram 46, which is connected to the secondary clamp die via a toggle linkage 45. Linkage 45 comprises a series of pivoted links 47,48 and 49. The first or rearmost link 47 is pivoted at one end to the bolster 30 via pivot pin 50, and is pivoted at the opposite end to the second link 48 via pivot pin 54. The hydraulic ram 46 is secured at its free or outermost end to an intermediate point on the first link 47 via pivot pin 55. Thus, extension and retraction of ram 46 will cause the link 47 to rotate about the fixed pivot 50. The hydraulic cylinder 44 is pivotally mounted to allow for the necessary rotation or angular movement of the drive assembly 40 due to the linkage design as the ram moves between the extended position of FIG. 2 and the retracted position of FIG. 3.

The second link 48 is an adjustable toggle link and is pivoted at one end to the first link, as noted above, and at the opposite end to the third link 49 via pivot pin 56. The third link 49 is rigidly secured to the secondary clamp die 34, and has a projection 57 pivotally secured to the bolster 30 via pivot pin 58. Thus, the toggle linkage causes link 49 to rotate about pivot pin 58 and thus moves the clamp die 34 between the extended and retracted positions, rotating the link 49 and clamp die through 90°, as illustrated in FIGS. 2 and 3.

As noted above, the hydraulic cylinder assembly will rotate slightly to accommodate the linkage movement back and forth between the positions of FIGS. 2 and 3. The cylinder will rotate clockwise between the extended position of FIG. 2 and the retracted position of FIG. 3. This movement is used to actuate a pair of proximity switches 60 mounted on the bolster 30 adjacent cylinder 44. A bracket 62 secured across the cylinder has an extension or flange 64 projecting over switches 60, with an opening 66 above the switches. The location of the opening 66 relative to the switches will determine which of the switches is actuated. When the cylinder is in the position of FIG. 2, where the ram is extended, the uppermost switch is partially covered while the lowermost switch is not covered. The uppermost switch is actuated in this position and sends a control signal to the control software of the system. When the cylinder rotates back into the position of FIG. 3, the uppermost switch is uncovered and the lowermost switch is covered and actuated, sending a different control signal to the software. This information is used for system control.

The system software may be designed to operate the hydraulic drive assembly to extend or retract the secondary clamp die depending on the type of bend to be formed. The linkage arrangement is such that, when the ram is fully extended as in FIG. 2, the first and second links 47 and 48 extend in a straight line and the thrust line of the hydraulic piston or ram is substantially aligned with the bearing or pivot between the first and second links. This provides a high rigidity for the supplemental clamp die when in the extended or operating position of FIGS. 1 and 2. The secondary clamp die will therefore bear against the tube when in the operative position, resisting slipping of the tube as it is bent. An inclined stop member 68 is preferably secured to the bolster via bolt 69, and forms a stop surface for the aligned first and second links in the extended position of FIG. 2.

When bends are to be formed close together, the secondary clamp die 34 is not needed and may in fact interfere with the tubing being bent. Thus, in this situation, the clamp die 34 is moved into the retracted or inoperative position by retracting ram or piston 46, pulling back the linkage 45, which in turn pulls back the arm or link 49 on which the clamp die 34 is mounted, rotating the link 49 about pivot 58 until the clamp die 34 swings away from the primary clamp die 32 into the retracted position, as illustrated in FIG. 3. In this position, the short, primary clamp die can be used in conjunction with the bend die to form closely adjacent bends in a tube.

If a bend is to be formed which is in a long straight length of tube, and not close to any previously formed bend, the secondary clamp die 34 is advanced into the extended position illustrated in FIGS. 2, 4 and 5. As illustrated, in this position the clamp face 38 of this die will bear against an opposing surface portion of the tube 18, acting to resist slipping. With the clamp dies advanced into position opposing the bend die 14 and gripping tube 18, as in FIG. 5, the bend arm is actuated in a conventional manner to rotate the entire assembly about the axis 24 of the bend die, as illustrated in dotted lines in FIG. 5. This forms a desired bend in the tube. Once the bending operation is complete, the clamp die apparatus is retracted to release the tube, the bend arm is rotated back into position with the clamp dies adjacent the pressure die 26, and the next portion of tube 18 is advanced. From FIG. 5, it can be seen that, if the secondary clamp die is in the retracted position of FIG. 3 while a bend is being formed, it will not interfere with the bending operation.

In the preferred embodiment described above, the secondary clamp die is rotated back and forth between the advanced and retracted positions by means of a toggle linkage. However, the secondary clamp die may alternatively be connected directly to the hydraulic ram for axial or linear movement back and forth between an advanced position and a rearwardly retracted position. The toggle linkage is preferred, however, since movement will be smoother and there will be less risk of the linkage and clamp die jamming on any other parts of the clamp die bolster with a rotational movement than with an axial or sliding movement. Additionally, although the drive assembly is a hydraulic cylinder and piston in the preferred embodiment, other drive mechanisms may alternatively be used, such as a lead screw, rack and pinion, or the like.

Although the primary and secondary clamp dies in the illustrated embodiment are straight clamp dies, curves may be incorporated into the dies if required for special purpose bending, or bending out of the plane of the clamp die, as will be understood by those skilled in the field. The clamp die apparatus as described above therefore allows the length of a clamp die to be adjusted readily between a relatively short die face and a longer die face, depending on the location of the bend to be formed. Such an adjustment could only be accomplished in the past by completely removing a clamp die and replacing it with a new, longer or shorter, clamp die. The die length adjustment with this apparatus can be performed automatically by the bend software, based on whether a bend is being formed close to a previously formed bend or in a long, straight tube section.

Although a preferred embodiment of the present invention has been described above by way of example only, it will be understood by those skilled in the field that modifications may be made to the disclosed embodiment without departing from the scope of the invention, which is defined by the appended claims.

I claim:

1. A clamp die apparatus for co-operating with a bend die of a tube bending apparatus during tube bending, the apparatus comprising:

a support bolster adapted for adjustable mounting on a bend arm of a tube bending machine;

a primary clamp die rigidly mounted in a fixed position on the support bolster for clamping a portion of a tube between the primary clamp die and a bend die of the bend arm;

a secondary clamp die movably mounted on the support bolster for movement between an extended position alongside the primary clamp die and a retracted position spaced rearwardly from the primary clamp die;

each clamp die having a clamping surface for bearing against a portion of a tube to be bent, the clamping surfaces of the primary and secondary clamp dies being aligned to form a clamping surface of extended length when the secondary clamp die is in the extended position, and the primary clamp die alone forming a reduced length clamping surface when the secondary clamp die is in the retracted position; and a drive assembly mounted on the support bolster for driving the secondary clamp die back and forth relative to the support bolster and primary clamp die between the extended and retracted positions, whereby a tube to be bent may selectively be clamped between the bend die and the primary clamp die alone with the secondary clamp die retracted during a tube bending operation, or with the secondary clamp die extended to bear against one side of the tube forward of the bend die and opposing primary clamp die during tube bending.

2. The apparatus as claimed in claim 1, wherein the primary and secondary clamp dies each have a clamping surface of predetermined length, and the predetermined length of the clamping surface of the primary clamp die is substantially equal to that of the bend die, and shorter than the length of the clamping surface of the secondary clamp die.

3. The apparatus as claimed in claim 1, wherein the secondary clamp die is rotatably mounted on the support bolster for rotation between the extended and retracted positions.

4. The apparatus as claimed in claim 2, wherein the clamping surface of the primary die has a length in the range from 1" to 2".

5. The apparatus as claimed in claim 4, wherein the clamping surface of the secondary die has a length in the range from 1" to 4".

6. The apparatus as claimed in claim 3, including a toggle linkage connecting the drive assembly to the secondary clamp die.

7. The apparatus as claimed in claim 6, wherein the support bolster has a rear end and a forward end, the primary clamp die being secured to the forward end of the support bolster, and the drive assembly comprises a hydraulic cylinder having a first end secured to the rear end of the support bolster and a second end, and a piston projecting out of the second end of the cylinder towards the forward end of the support bolster for movement between extended and retracted positions, the piston having an outer end pivotally secured to said toggle linkage.

8. The apparatus as claimed in claim 7, wherein the cylinder has a rear end and a forward end, the piston projecting out of the forward end, and the rear end of the cylinder being pivotally mounted on the support bolster to define a drive pivot axis, the cylinder being movable through an arc about said drive pivot axis as said linkage is moved between the extended and retracted positions of said secondary clamp die and drive piston.

9. A clamp die apparatus for co-operating with a bend die of a tube bending apparatus during tube bending, the apparatus comprising:

a support bolster adapted for adjustable mounting on a bend arm of a tube bending machine;

a primary clamp die rigidly mounted on the support bolster for clamping a portion of a tube between the primary clamp die and a bend die of the bend arm;

a secondary clamp die rotatably mounted on the support bolster for rotation between an extended position alongside the primary clamp die and a retracted position spaced rearwardly from the primary clamp die;

each clamp die having a clamping surface for bearing against a portion of a tube to be bent, the clamping surfaces of the primary and secondary clamp dies being aligned to form a clamping surface of extended length when the secondary clamp die is in the extended position, and the primary clamp die alone forming a reduced length clamping surface when the secondary clamp die is in the retracted position;

a drive assembly on the support bolster for driving the secondary clamp die back and forth between the extended and retracted positions;

a toggle linkage connecting the drive assembly to the secondary clamp die; and the toggle linkage including first and second links each having opposite first and second ends, the first end of the first link being pivotally mounted on the support bolster to define a first pivot axis and the second end of the first link being pivoted to the first end of the second link via a second pivot, the drive assembly being secured to the first link at a location spaced between its first and second ends, and the secondary die clamp being connected to the second end of the second link.

10. The apparatus as claimed in claim 9, including a link arm having a first end secured to the secondary die clamp and a second end pivotally mounted on the support bolster to define a second pivot axis, the link arm having a portion projecting rearwardly from the secondary die clamp at an angle to the clamping surface towards said second end of said link arm, and the second link of the toggle linkage being pivoted to the link arm at a location spaced rearwardly from the secondary die clamp, whereby operation of the drive assembly rotates the link arm about said second pivot axis to move said secondary clamp die between the extended and retracted positions.

11. The apparatus as claimed in claim 9, wherein the first and second links of the toggle linkage are aligned in a substantially straight line when the secondary clamp die is in the extended position.

12. The apparatus as claimed in claim 9, wherein the drive assembly comprises a hydraulic cylinder and a piston projecting out of said cylinder, the piston having an outer end pivotally secured to said first link, whereby extension of said piston in a first direction out of said cylinder rotates said first link about said first pivot axis to move said secondary clamp die into said extended position, and retraction of said piston in a second direction into said cylinder rotates said first link in the opposite direction to pull said secondary clamp die back into said retracted position.

13. The apparatus as claimed in claim 12, wherein the piston has a longitudinal axis substantially in line with said second pivot between the first and second links when said secondary clamp die is in the extended position.

14. A clamp die apparatus for co-operating with a bend die of a tube bending apparatus during tube bending, the apparatus comprising:

a support bolster adapted for adjustable mounting on a bend arm of a tube bending machine;

a primary clamp die rigidly mounted on the support bolster for clamping a portion of a tube between the primary clamp die and a bend die of the bend arm;

a secondary clamp die rotatable mounted on the support bolster for rotation between an extended position alongside the primary clamp die and a retracted position spaced rearwardly from the primary clamp die;

each clamp die having a clamping surface for bearing against a portion of a tube to be bent, the clamping surfaces of the primary and secondary clamp dies being aligned to form a clamping surface of extended length when the secondary clamp die is in the extended position, and the primary clamp die alone forming a reduced length clamping surface when the secondary clamp die is in the retracted position;

a drive assembly on the support bolster for driving the secondary clamp die back and forth between the extended and retracted positions;

a toggle linkage connecting the drive assembly to the secondary clamp die;

the drive assembly comprising a hydraulic cylinder and a piston projecting out of the cylinder for movement between extended and retracted positions, the piston having an outer end pivotally secured to said toggle linkage;

the cylinder having a rear end and a forward end, the piston projecting out of the forward end, and the rear end of the cylinder being pivotally mounted on the support bolster to define a drive pivot axis, the cylinder being movable through an arc about said drive pivot axis as said linkage is moved between the extended and retracted positions of said secondary clamp die and drive piston; and a proximity switch device between said cylinder and said support bolster, the switch device including at least one switch on said support bolster and a switch actuator on said cylinder for actuating said switch on movement of said cylinder as said secondary clamp die is extended.

15. A tube bending apparatus, comprising:

a swinging bend arm assembly mounted for rotation about a bend axis;

a bend die defining a die surface of a first length mounted on the bend arm assembly; and a clamp die assembly adjustably mounted on the bend arm assembly opposing the bend die for engaging a portion of a tube to be bent between the clamp die assembly and bend die;

the clamp die assembly comprising a support bolster, a primary clamp die rigidly mounted on the support bolster and having a clamping surface of length substantially equal to said first length for gripping a portion of a tube between the clamp die and bend die as the bend arm assembly is rotated to form a bend in the tube; and a secondary clamp die rotatably mounted on the support bolster for movement between an extended position alongside the primary clamp die and a retracted position spaced rearwardly from the primary clamp die;

the secondary clamp die having a clamping face aligned with the clamping face of the primary clamp die in the extended position to form an extension of said primary clamp die clamping face, whereby the secondary clamp die bears against a portion of a tube in advance of said bend die and primary clamp die in said extended position.

16. The apparatus as claimed in claim 15, wherein the secondary clamp die is rotatably mounted on the support bolster for rotation between the extended and retracted positions.

17. The apparatus as claimed in claim 16, including a drive assembly mounted on the support bolster for driving the secondary clamp die back and forth between the extended and retracted positions, and a toggle linkage connecting the drive assembly to the secondary clamp die.

18. The apparatus as claimed in claim 17, wherein the drive assembly comprises a hydraulic cylinder and a piston projecting out of the cylinder for movement between extended and retracted positions, the piston having an outer end pivotally secured to said toggle linkage.

* * * * *